US006698056B1

(12) United States Patent
Oretti et al.

(10) Patent No.: US 6,698,056 B1
(45) Date of Patent: Mar. 2, 2004

(54) BUTTERFLY SPONGE MOP WITH ANGLE-ADJUSTABLE HANDLE

(75) Inventors: John Ernest Oretti, Doncaster; Jan-Anders Schjottelvig, Cottlesbridge, both of (AU)

(73) Assignee: E. D. Oates Pty Ltd., Reservoir (AU)

( * ) Notice: Subject to any disclaimer, the term of this patent is extended or adjusted under 35 U.S.C. 154(b) by 0 days.

(21) Appl. No.: 09/463,606

(22) PCT Filed: Jul. 28, 1998

(86) PCT No.: PCT/AU98/00599

§ 371 (c)(1),
(2), (4) Date: Jan. 25, 2000

(87) PCT Pub. No.: WO99/05957

PCT Pub. Date: Feb. 11, 1999

(30) Foreign Application Priority Data

Jul. 28, 1997 (AU) ..... PO 8273

(51) Int. Cl.[7] ..... A47L 13/146
(52) U.S. Cl. ..... 15/119.2; 15/244.2
(58) Field of Search ..... 15/116.2, 118, 15/119.2, 121, 244.2

(56) References Cited

U.S. PATENT DOCUMENTS 2,801,433 A * 8/1957 Palma, Jr. et al. ..... 15/119.2
2,864,107 A * 12/1958 Greenleaf ..... 15/119.2
2,892,201 A * 6/1959 Peterson et al. ..... 15/119.2
2,893,033 A 7/1959 Vosbikian et al. ..... 15/144.2
2,959,799 A * 11/1960 Greenleaf et al. ..... 15/119.2
2,961,676 A * 11/1960 Rebernak et al. ..... 15/119.2
3,224,025 A * 12/1965 Altrock ..... 15/119.2
4,312,092 A * 1/1982 Lundgren ..... 15/119.2
4,748,710 A * 6/1988 Jones ..... 15/119.2
5,483,720 A * 1/1996 Decoopman et al. ..... 15/119.2
5,979,004 A * 11/1999 Wilson ..... 15/119.2

FOREIGN PATENT DOCUMENTS

EP 494021 A1 7/1992
SE 302670 * 7/1968 ..... 15/119.2

* cited by examiner

*Primary Examiner*—Mark Spisich
(74) *Attorney, Agent, or Firm*—Michael Best & Friedrich LLP; Grady J. Frenchick

(57) ABSTRACT

A butterfly sponge mop (1) which has a mop handle (2) which can be set at a desired angle with respect to the wings (12,14) of the mop. The handle is attached to a swivel housing (34) which is provided between the wings, by a swivel connector (32) provided with a swivel pin (38). The axis of the swivel pin is at an angle to the axis of the handle so that rotation of the handle and swivel connector sets the angle of the handle.

12 Claims, 8 Drawing Sheets

BUTTERFLY SPONGE MOP WITH ANGLE-ADJUSTABLE HANDLE

FIELD OF THE INVENTION

The present invention relates to sponge mops, and more particularly to "butterfly" type sponge mops.

BACKGROUND OF THE INVENTION

Conventional butterfly sponge mops include an elongate handle, a mop head comprising a sponge mounted on a pair of pivotable horizontal coplanar wings, and a squeeze mechanism for pivoting the wings into a vertical parallel position to compress the sponge and extract liquid therefrom. Typically, the mop head is mounted transverse to one end of the handle at a fixed angle to the axis of the handle. This is disadvantageous in that the head can only conform with a surface for efficacious mopping if the handle is maintained at a fixed angle to the surface. Furthermore, because the head is held at a fixed angle, it takes up a large amount of space when packaged or hung off supermarket shelves.

A possible solution to these problems is to allow the head to freely pivot at one end of the handle about an axis transverse to the axis of the handle. While this solution allows the head to freely pivot into conformity with a surface if the angle between the handle and the surface is varied, frictional forces parallel to the axis of the handle typically cause the head to freely pivot out of conformity with the surface during mopping. Additionally they may flop about during movement making the step of packaging into a box or hanging on a supermarket rack a more difficult exercise.

Conventional butterfly mops are therefore inefficacious in situations where ergonomics require variation of the angle between the handle and the surface during mopping. Such situations include the mopping of vertical surfaces, the mopping of elevated surfaces, and the mopping of surfaces under projections or with low overhangs.

In addition to the above disadvantageous functionality, conventional butterfly sponge mops are characterised by complicated squeeze mechanisms for extracting liquid from the sponge and complicated and inefficient arrangements for mounting the sponge on the head.

A requirement accordingly exists for a butterfly sponge mop wherein the head can be positively adjusted to a desired angle during mopping, and wherein both the squeeze mechanism and the sponge mounting arrangement are simple in construction and efficient in operation.

DISCLOSURE OF THE INVENTION

According to the present invention, there is provided a butterfly sponge mop including:

- a mop handle;
- a mop head comprising a pair of pivotable wings including means for holding the wings in a common plane;
- means for mounting a sponge on the wings;
- a squeeze mechanism for pivoting the wings to compress the sponge therebetween; and
- a swivel assembly for rotatably connecting one end of the handle to the head such that the rotational configuration of the handle with respect to the head sets the relative angle made between the handle and the common plane.

Suitably the wings are of a generally planar configuration. They may be resiliently biased towards a coplaner position for mopping.

Advantageously, the swivel assembly includes a swivel connector and a swivel housing. The swivel connector advantageously has a front end and a rear end. The rear end includes a handle mounting socket and the front end includes a swivel pin. The handle mounting socket is angularly offset from the swivel pin. Conveniently, one end of the handle is retained against rotation in the handle mounting socket. Advantageously, the swivel housing includes a swivel socket portion and an disposed elongate body portion. The swivel socket portion may be angularly offset from the longitudinal axis of the body portion. The swivel socket portion advantageously has an unrestricted rear opening and a restricted front opening. The swivel connector is suitably received in the unrestricted rear opening such that swivel pin of the swivel connector extends through the restricted front opening of the swivel socket portion. Conveniently, the swivel pin is locked against the restricted front opening such that the swivel connector is freely rotatable but axially secured to the swivel socket portion of the swivel housing. Advantageously, the body portion of the swivel housing has a generally lower surface for mounting the pivotable wings such that the pivot axis of the wings is parallel to the longitudinal axis of the body portion.

As described above, the swivel connector and the swivel housing rotatably connect one end of the handle to the head such that the head can be conformed to a surface by relative rotation of the head and the handle if the angle between the handle and the surface is varied during mopping.

Advantageously, the squeeze mechanism includes an actuator sleeve and a compression clevis. The actuator sleeve is advantageously coaxially slidably mounted on the handle. The compression clevis is generally U-shaped and advantageously comprises a cross member having two fingers disposed normal thereto and extending from each of its ends. Conveniently, each finger of the compression clevis has a cam-like lower abutment surface. The free ends of the fingers of the compression clevis are advantageously pivotably connected to the body portion of the swivel housing about a pivot axis transverse to the longitudinal axis of the body portion such that the cam-like lower abutment surfaces of the fingers are proximate to the upper surfaces of the wings. Advantageously, the actuator sleeve is operatively connected to the compression clevis by a control member having a first end and a second opposite end, the second end being angularly offset from the first end. The first end of the control member is advantageously pivotably connected to the actuator sleeve about a pivot axis transverse to the axis of the handle, and the second opposite end of the control member is advantageously pivotably connected to the cross member of the compression clevis about a pivot axis parallel to the pivot axis of the fingers. Conveniently, the angular offset between the first and second opposite ends of the control rod accommodates angular displacement of the compression clevis relative to the actuator sleeve when the handle is rotated relative to the head to conform the head to a surface during mopping.

As described above, the squeeze mechanism is operable to simultaneously pivot the wings from the horizontal coplanar mopping position to a squeezing position where they are parallel for compressing the sponge and extracting liquid therefrom. Specifically, movement of the actuator sleeve towards the head causes the control member to concomitantly move towards the cross member of the compression clevis, which in turn causes the fingers of the compression clevis to pivot such that the cam-like lower abutment surfaces of the fingers abut the upper surfaces of the wings in a camming motion to simultaneously pivot the wings into a vertical parallel position.

Advantageously, the wings are configured such that the head defines a trapezoidal plan shape to facilitate mopping in corners and/or confined spaces. Further or in the alternative, the upper surfaces of the wings may be bevelled for this purpose.

Advantageously, the sponge is generally identical in plan shape to the head and has an upper surface and a lower surface. The sponge is advantageously removably mounted on the lower surfaces of the wings by mounting plates secured to the upper surface of the sponge that are slidably lockable in complementary key structures formed on the lower surfaces of each wing. Conveniently, a key structure is formed on the lower surface of each wing generally parallel to the pivot axis of the wings, and two mounting plates are secured to the upper surface of the sponge in aligned spaced apart relationship transverse to the longitudinal axis of the sponge. Preferably, each key structure includes a recess formed in the front edge of the respective wing and each mounting plate includes a complementary locking tab arranged adjacent the corresponding front edge of the sponge.

As described above, the sponge is removably mounted on the lower surface of the wings by simultaneously sliding the respective mounting plates on the sponge into the respective key structures on the lower surfaces of the wings until the locking tabs on the mounting plates are lockably received in the complementary recesses in the wings.

Advantageously, an auxiliary cleaning tool, such as a scouring pad or a squeegee, is selectively removably mounted on the front of the body portion of the swivel housing. The auxiliary cleaning tool is advantageously removably mounted by a mounting plate provided on the auxiliary cleaning tool that is slidably lockable in a complementary key structure formed in the front of the body portion. Conveniently, the key structure is formed in the front of the body portion perpendicular to the longitudinal axis of the body portion. The mounting plate is advantageously arranged on the auxiliary cleaning tool such that the operative face of the auxiliary cleaning tool is parallel to the head when the mounting plate is slidably locked in the complementary key structure. As with the head, the operative face of the auxiliary cleaning tool, such as the blade of a squeegee, may be conformed to a surface by relative rotation of the handle and the head during cleaning.

An embodiment of the invention will now be described by way of example only with reference to the accompanying drawings, in which:

DETAILED DESCRIPTION OF THE PREFERRED EMBODIMENTS

Figures 1, 2:
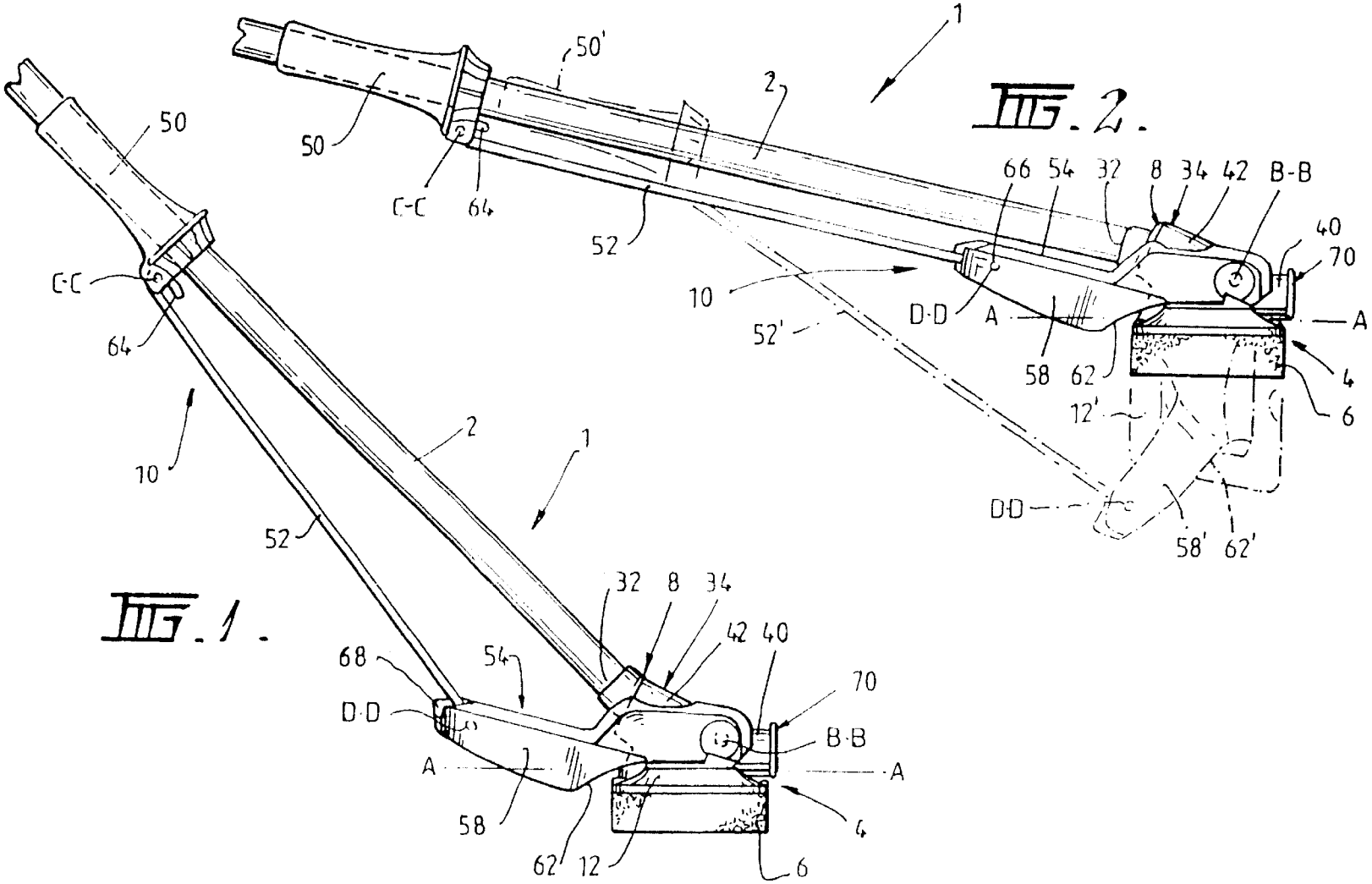
FIG. 1 is a fragmentary side view of a butterfly sponge mop according to a preferred embodiment of the invention.
FIG. 2 is a fragmentary side view of the butterfly sponge mop of FIG. 1 illustrating the operation of both the swivel assembly and the squeeze mechanism.

The illustrated embodiment of the butterfly sponge mop 1 of the present invention generally includes a mop handle 2, a mop head 4, a sponge 6, a swivel assembly 8, and a squeeze mechanism 10. The construction and arrangement of these general components is discussed in detail below.

The handle 2 is a generally elongate hollow or solid cylinder and may be constructed of any of the range of commercially available materials conventionally used in mops and brushware. Such materials include plastic materials such as polypropylene or polyethylene, or materials such as wooden dowel or aluminium tube.

Figures 3, 6:
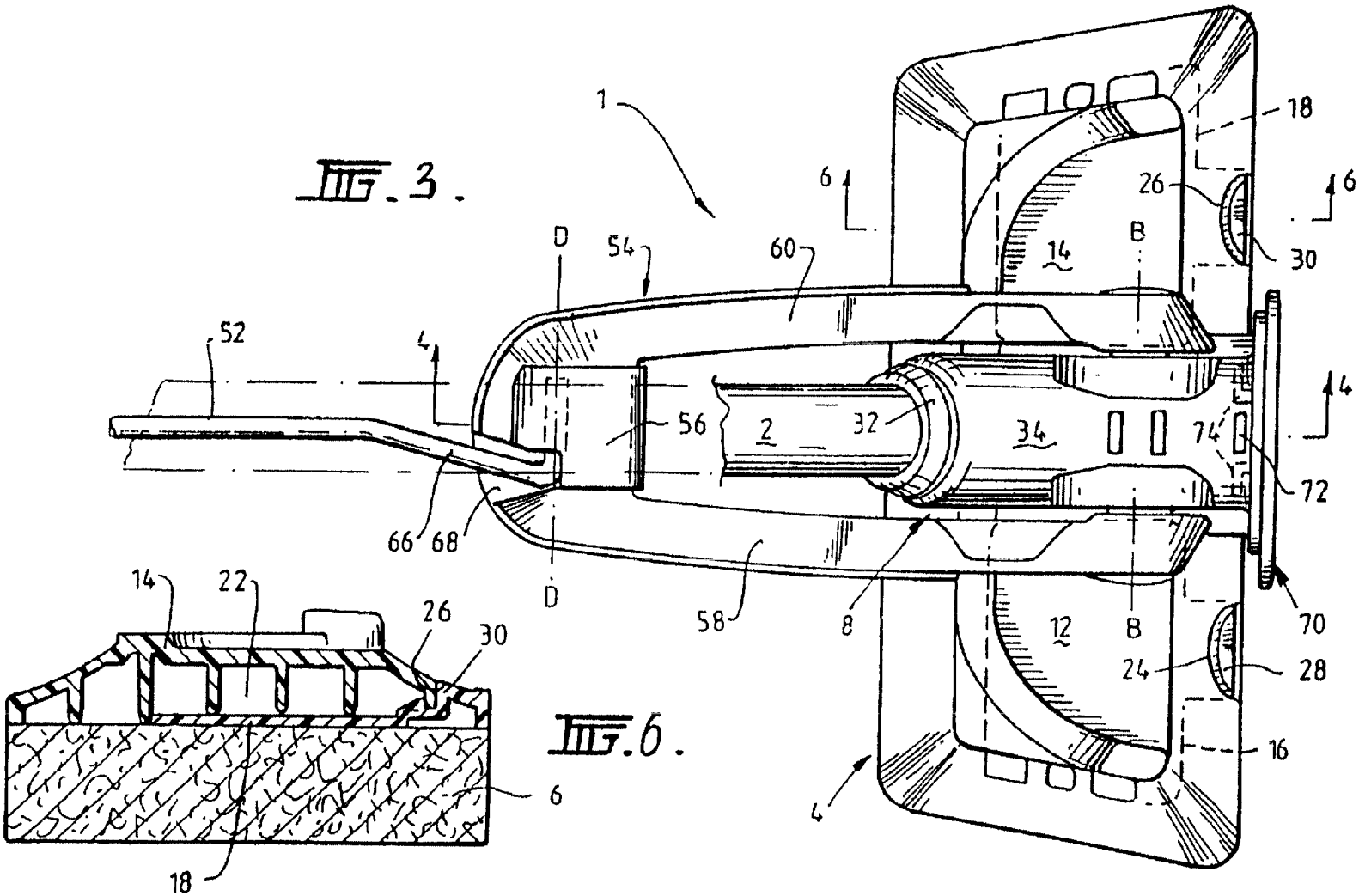
FIG. 3 is a plan view of the butterfly sponge mop of FIG. 1.
FIG. 6 is a fragmentary sectioned view in the direction of arrows 6—6 in FIG. 3.

The mop head 4 comprises a pair of hinged planar wings 12, 14 arranged in an aligned horizontal coplanar position for mopping. The wings 12, 14 are pivotable about pivot axis A-A and are biased in the horizontal coplanar mopping position by a spring (not shown) arranged transverse to pivot axis A-A that resiliently interconnects the upper surfaces of the wings 12, 14. As illustrated in FIG. 3, the wings 12, 14 are configured such that the head 4 defines a trapezoidal plan shape to facilitate mopping in corners and/or confined spaces. As also illustrated in FIG. 3, the upper surfaces of the wings may be bevelled for this purpose. The hinged wings 12, 14 are advantageously integrally moulded of a conventional plastic material such as polypropylene or polyethylene.

Figure 5:
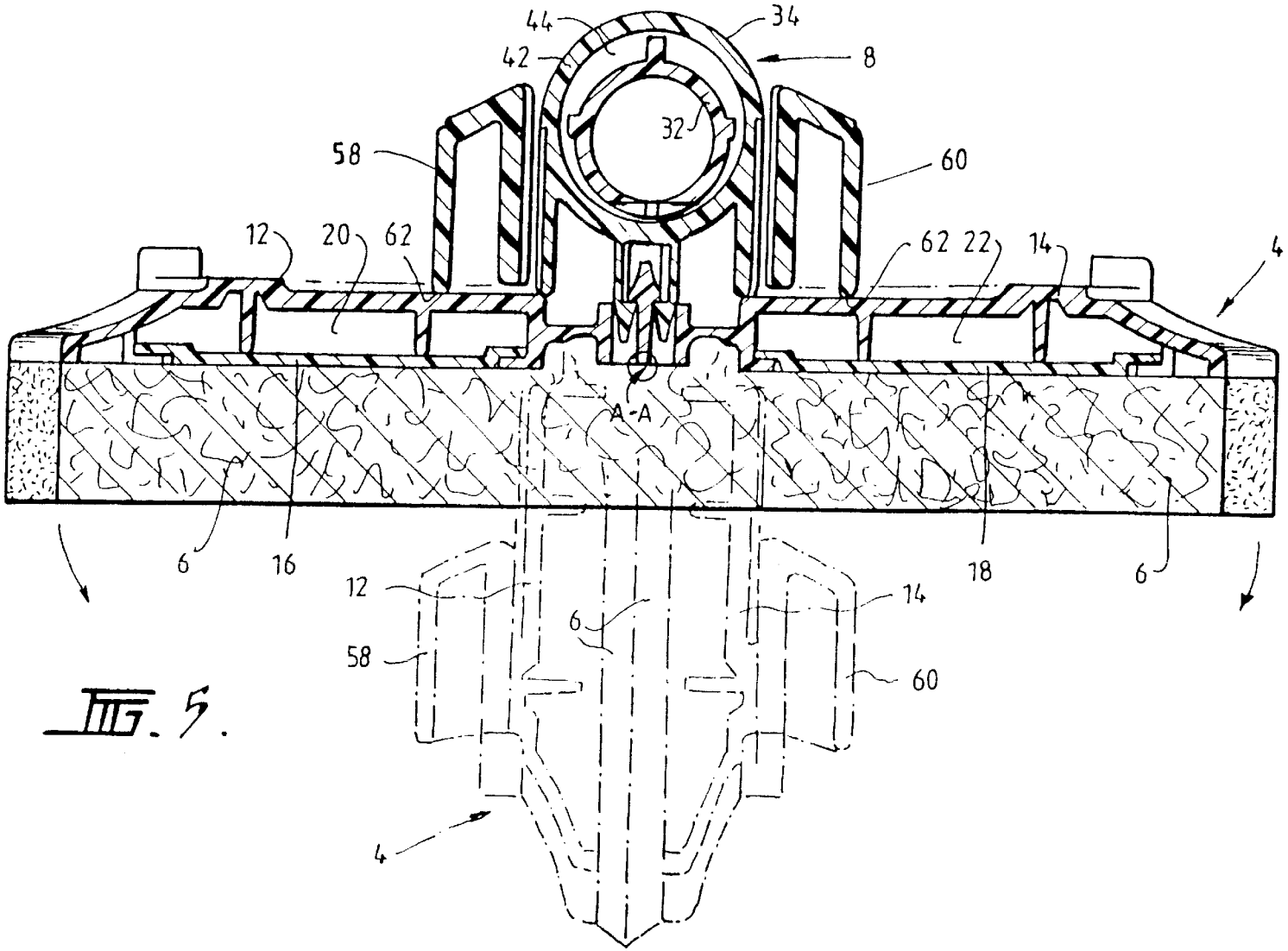
FIG. 5 is a fragmentary sectioned view in the direction of arrows 5—5 in FIG. 4.
Figure 8:
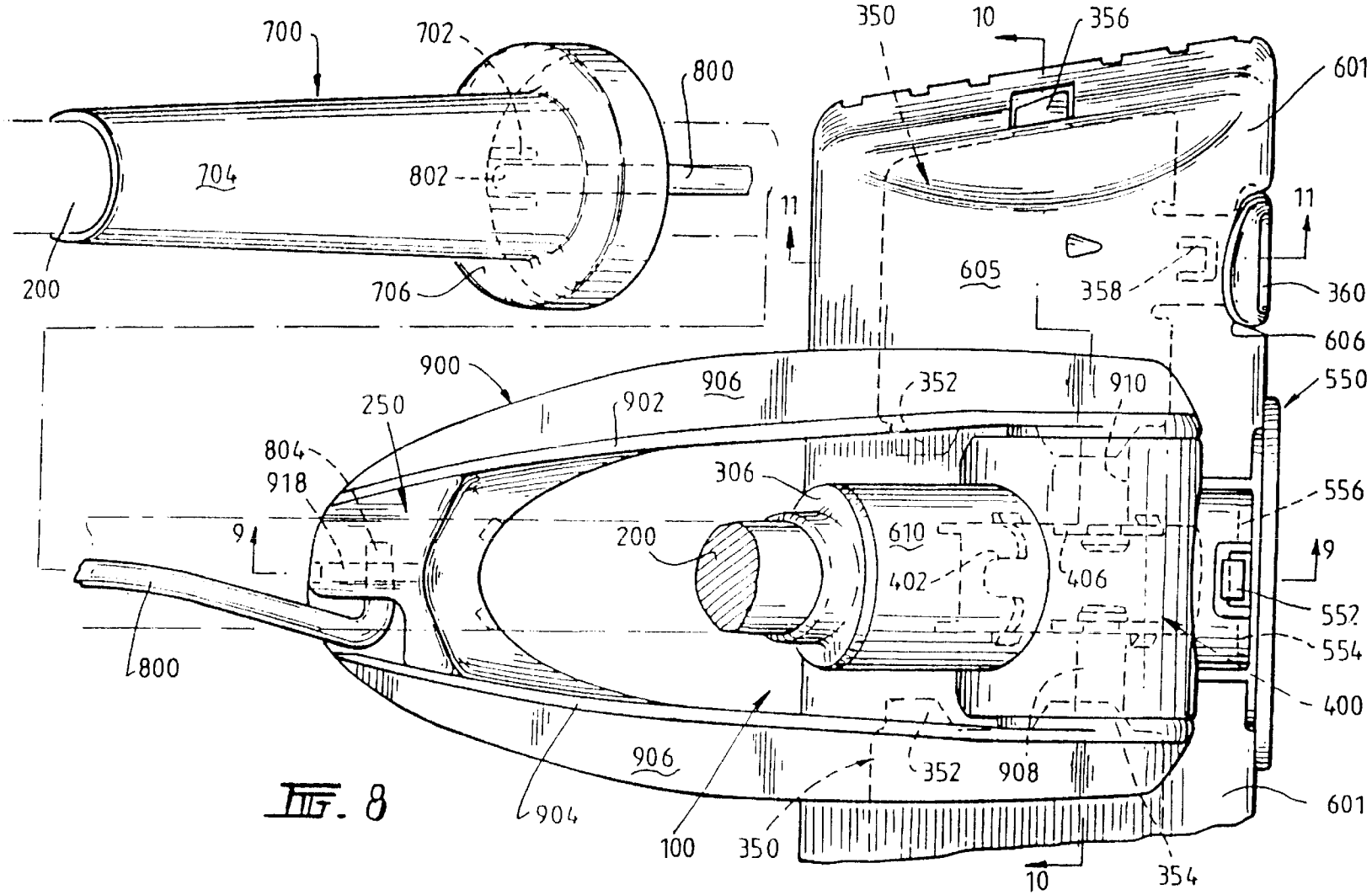
FIG. 8 is a sectional plan view of the head of a butterfly sponge mop in accordance with the invention.
Figure 9:
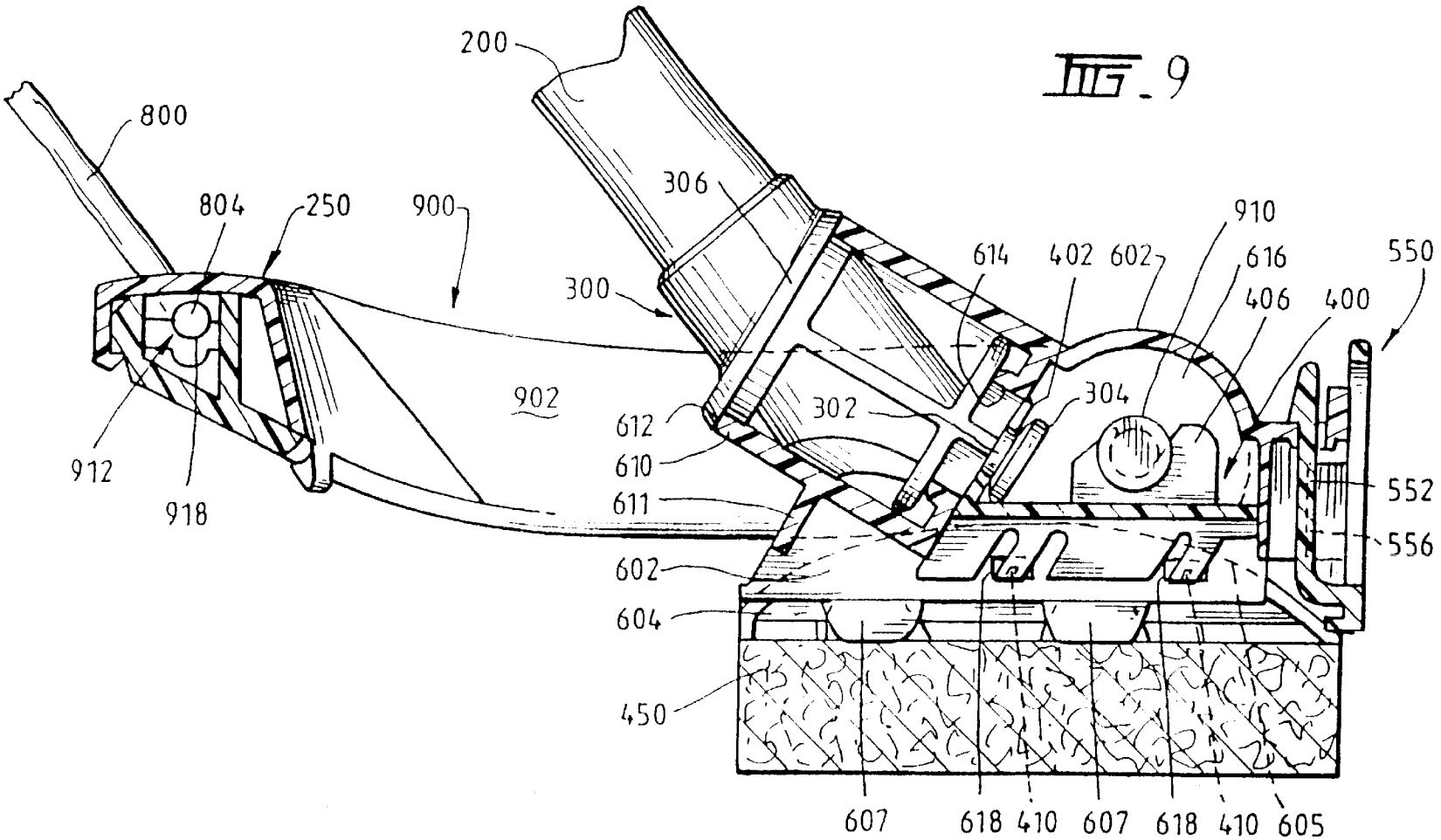
FIG. 9 is a cross sectional view taken along the direction of the arrows 9—9 in FIG. 8.
Figure 11:
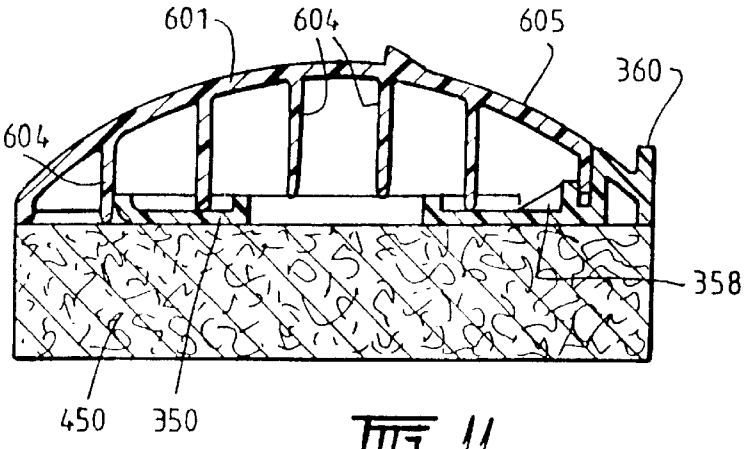
FIG. 11 is a cross sectional view taken along the direction of the arrows 11—11 in FIG. 8.
Figure 10:
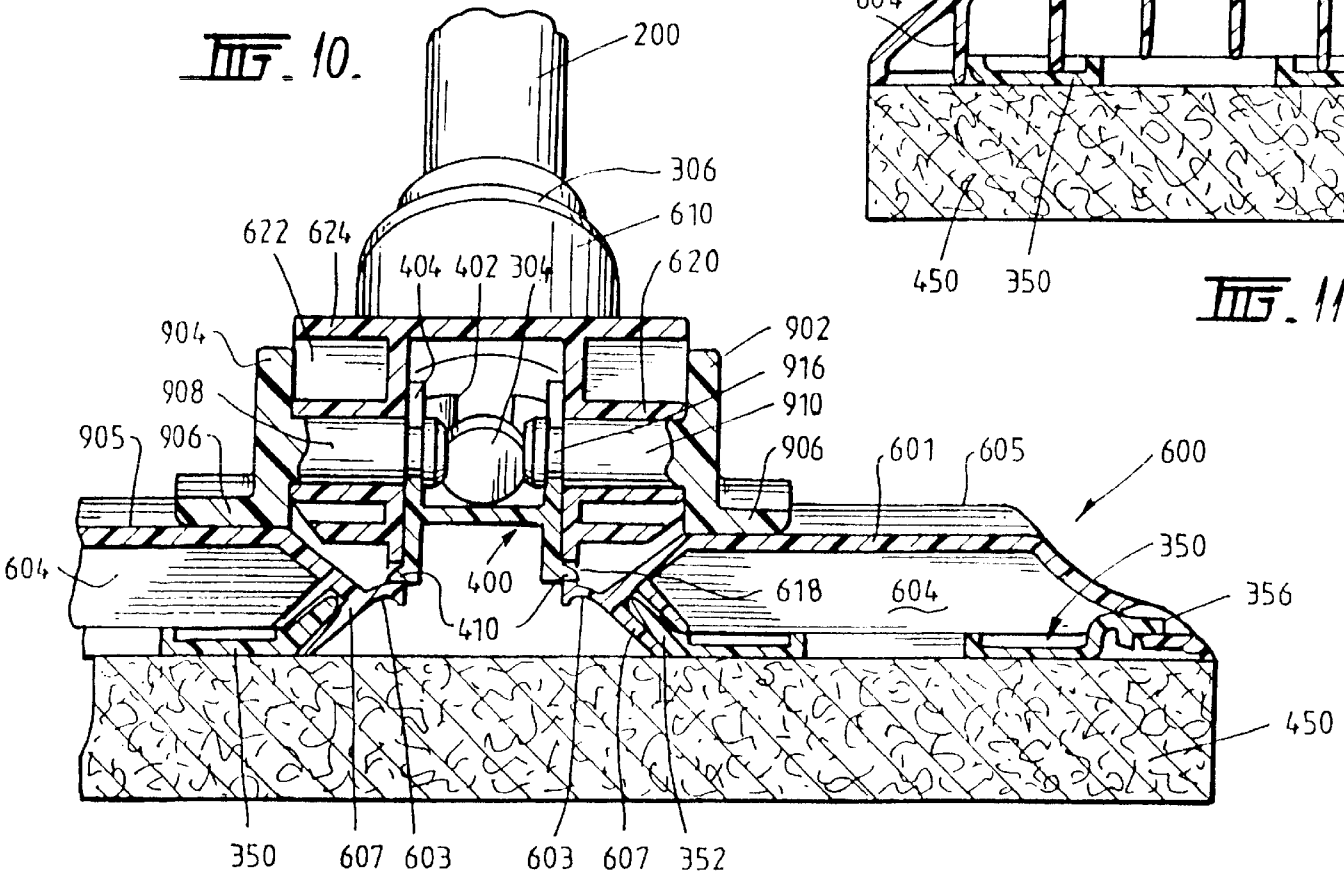
FIG. 10 is a cross sectional view taken along the direction of the arrows 10—10 in FIG. 8.
Figure 12:
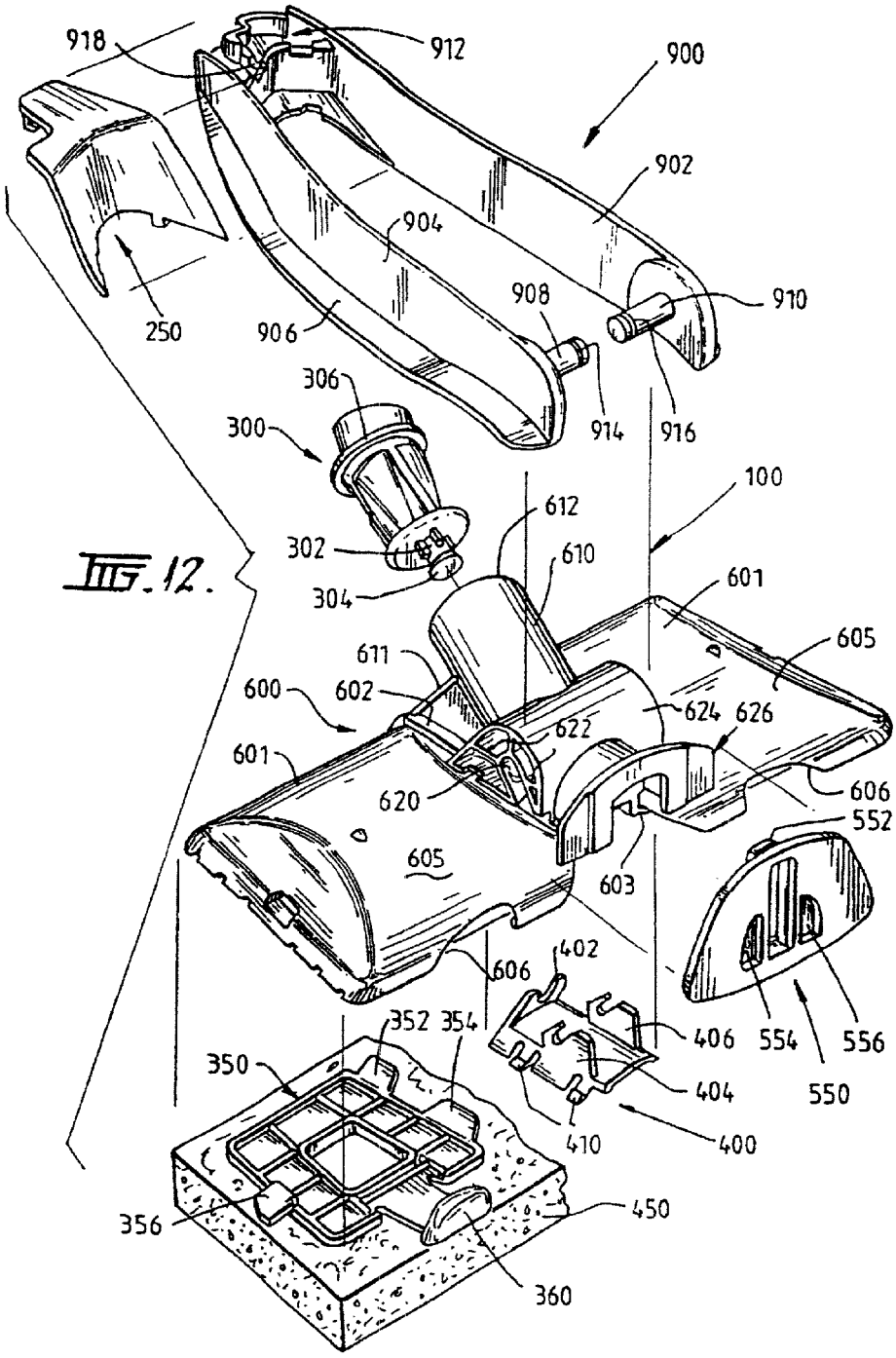
FIG. 12 is an exploded view of part of the butterfly sponge mop shown in FIGS. 8 to 11.

The sponge 6 comprises conventional commercially available sponge material and is generally identical in plan shape to the head 4. As illustrated in FIGS. 5 and 6, the sponge 6 is removably mounted on the lower surfaces of the wings 12, 14 by mounting plates 16, 18 secured to the upper surface of the sponge 6 in aligned spaced apart relationship transverse to the longitudinal axis of the sponge 6. The mounting plates 16, 18 are advantageously moulded of a conventional plastic material such as polypropylene or polyethylene and are secured to the upper surface of the sponge 6 by adhesive. The mounting plates 16, 18 are slidably received in complementary key structures 20, 22 formed on the lower surfaces of each wing 12, 14 generally parallel to pivot axis A-A of the wings 12, 14. As illustrated in FIG. 3, the key structures 20, 22 include locking recesses 24, 26 formed in the front edges of the wings 12, 14 and the mounting plates 16, 18 include complementary locking tabs 28, 30 arranged adjacent the corresponding front edge of the sponge 6. It will be appreciated from the above description that the sponge 6 is removably mounted on the lower surfaces of the wings 12, 14 by simultaneously sliding the respective mounting plates 16, 18 into the respective key structures 20, 22 until the locking tabs 28, 30 are lockably received in the complementary locking recesses 24, 26.

Figure 4:
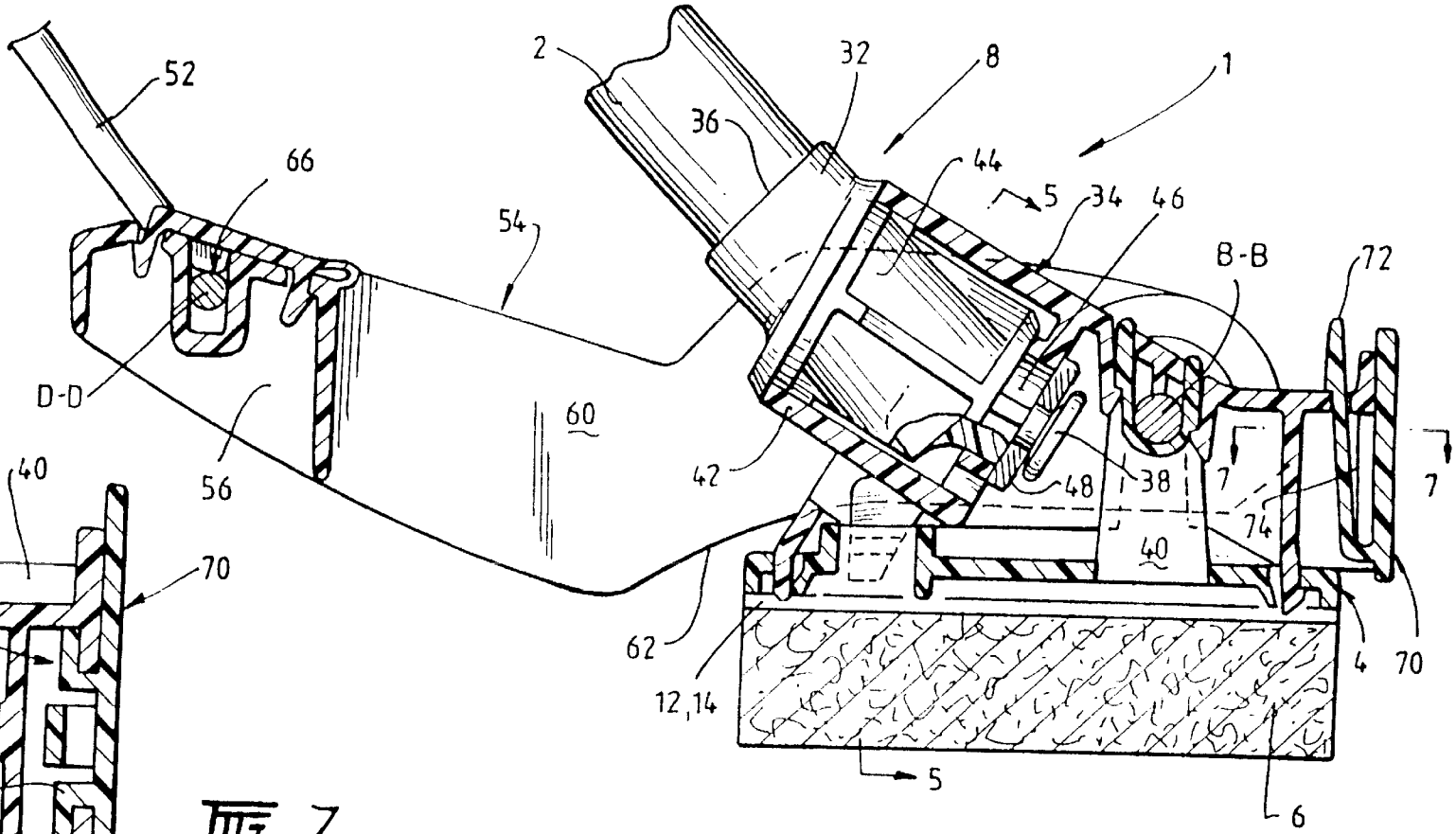
FIG. 4 is a fragmentary sectioned view in the direction of arrows 4—4 in FIG. 3.

The head 4 is rotatably connected to one end of the handle 2 at an angle to the longitudinal axis of the handle 2 by a swivel assembly 8. The angle may be varied with rotation of the handle relative to the head. It may be adjusted so that the relative angle between the handle and plane of the extended wings is reduced to reduce the overall bulk of the mop to facilitate packaging. The angle may be reduced to 25 degrees or even less. The swivel assembly 8 generally comprises a swivel connector 32 and a swivel housing 34. As illustrated in FIG. 4, the swivel connector 32 is generally cylindrical and has a rear end including a generally cylindrical handle mounting socket 36 and a front end including a swivel pin 38 that is angularly offset from the handle mounting socket 36. One end of the handle 2 is retained against rotation in the handle mounting socket 36 by conventional releasable fastening means (not shown), such as a screw or rivet.

The swivel housing 34 includes a horizontally disposed elongate body portion 40 and a generally cylindrical swivel socket portion 42 angularly offset from the longitudinal axis of the body portion 40. The swivel socket portion 42 has an unrestricted rear opening 44 and a restricted front opening 46. The swivel connector 32 is received in the unrestricted rear opening 44 such that swivel pin 38 of the swivel connector 32 extends through the restricted front opening 46 of the swivel socket portion 42. The swivel pin 38 is locked against the restricted front opening 46 by a generally C-shaped locking collar 48 that positively permanently snap-fits over the shaft, and behind the head, of the swivel pin 38. As thus arranged, the swivel connector 32 is freely rotatable but axially secured to the swivel socket portion 42 of the swivel housing 34. The body portion 40 of the swivel housing 34 has a generally planar lower surface and the pivotable wings 12, 14 are mounted thereto such that the pivot axis A-A of the wings is parallel to the longitudinal axis of the body portion 40.

The swivel connector 32, the swivel housing 34, and the locking collar 48 are advantageously moulded of a conventional plastic material such as polypropylene or polyethylene. Further, the hinged wings 12, 14, the swivel connector 32, the swivel housing 34, and the locking collar 48 are advantageously designed and configured to positively permanently snap-fit together.

It will be appreciated from the above description that the swivel assembly 8 rotatably connects one end of the handle 2 to the head 4 at an angle such that relative rotation of the handle 2 and the head 4 about the swivel assembly 8 varies the relative angle of the handle 2 and the head 4 as illustrated in FIG. 2. It will be further appreciated that the swivel assembly 8 facilitates efficacious mopping by allowing the head 4 to be positively conformed to a surface in situations where ergonomics require variation of the angle between the handle 2 and the surface during mopping. Such situations include the mopping of walls and windows, the mopping of ceilings, the mopping of stairs, and the mopping of floors under cupboards and under furniture with short legs.

The squeeze mechanism 10 generally comprises an actuator sleeve 50, a control member 52, and a compression clevis 54. The actuator sleeve 50 is coaxially slidably mounted on the handle 2 for telescopic movement therewith and the generally U-shaped compression clevis 54 comprises a cross member 56 having two fingers 58, 60 disposed normal thereto and extending from each of its ends. Advantageously, each finger 58, 60 has a cam-like lower abutment surface 62. The free ends of the fingers 58, 60 of the compression clevis 54 are pivotably connected to the body portion 40 of the swivel housing 34 about a pivot axis B-B transverse to the pivot axis A-A of the wings 12, 14 such that the cam-like lower abutment surfaces 62 of the fingers 58, 60 are proximate to the upper surfaces of the wings 12, 14.

The actuator sleeve 50 is operatively connected to the compression clevis 54 by the control member 52. The control member 52 advantageously comprises a metal rod and has a first end 64 and a second opposite end 66 angularly offset from the first end 64. The first end 64 of the control member 52 is pivotably connected to the actuator sleeve 50 about a pivot axis C-C transverse to the axis of the handle, aid the second end 66 of the control member 52 is pivotably connected to the cross member 56 of the compression clevis 54 about a pivot axis D-D parallel to the pivot axis B-B of the fingers 58, 60. As illustrated in FIG. 3. the cross member 56 of the compression clevis 54 is provided with an angled recess 68 to accommodate the angular offset of the second end 66 of the control member 52. In use, the angularly offset second end 66 of the control member 52 slides in the angled recess 68 to accommodate angular displacement of the compression clevis 54 relative to the actuator sleeve 50 when the handle 2 is rotated relative to the head 4 to positively conform the head 4 to a surface during mopping.

It will he appreciated from the above description that the squeeze mechanism 10 is operable to simultaneously pivot the wings 12, 14 from the horizontal coplanar mopping position to a vertical parallel position (illustrated in outline in FIGS. 2 and 5) for compressing the sponge and extracting liquid therefrom. As illustrated in FIG. 2, movement of the actuator sleeve 50 towards the head 4 causes the control member 52 to concomitantly move towards the cross member 56 of the compression clevis 54, which in turn causes the fingers 58, 60 of the compression clevis 54 to pivot about pivot axis B-B such that the cam-like lower abutment surfaces 62 of the fingers 58, 60 abut the upper surfaces of the wings 12, 14 in a camming motion to simultaneously pivot the wings 12, 14 in the direction of the arrows illustrated in FIG. 5 into a vertical parallel position. It will be appreciated that the when the above operation is reversed, the wings 12, 14 will be returned to the horizontal coplanar mopping position by the spring (not shown) arranged transverse to pivot axis A-A that resiliently interconnects the upper surfaces of the wings 12, 14.

Figure 7:
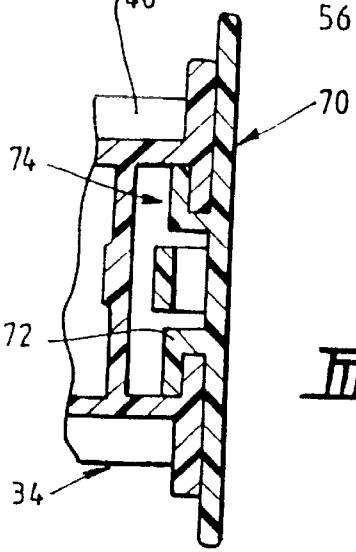
FIG. 7 is a fragmentary sectioned view in the direction of arrows 7—7 in FIG. 4.

The illustrated embodiment of the present invention also includes means for selectively mounting an auxiliary cleaning tool 70, such as a scourer or a squeegee, on the front of the body portion 40 of the swivel housing 34. As illustrated in FIGS. 4 and 7, the auxiliary cleaning tool 70 is mounted by a mounting plate 72 provided on the auxiliary cleaning tool 70 that is slidably lockable in a complementary key structure 74 formed in the front of the body portion 40. The key structure 74 is formed in the front of the body portion 40 perpendicular to the longitudinal axis of the body portion 40. The mounting plate 72 is arranged on the auxiliary cleaning tool 70 such that the operative face of the auxiliary cleaning tool 70 is parallel to the head 4 when the mounting plate 72 is slidably locked in the key structure 74. The key structure 74 is advantageously moulded of a plastic material such as polypropylene or polyethylene and may be designed and configured to positively permanently snap-fit to the body portion 40 of the swivel housing 34. It will he appreciated that the operative face of the auxiliary cleaning tool 70, such as the pad of a scourer or the blade of a squeegee, may be conformed to a surface by relative rotation of the handle 2 aid the head 4 during cleaning.

Referring to FIGS. 8 to 12, there is shown a butterfly sponge mop having a head 600 provided with a pair of wings 601 attached to a mounting member 602 by an integral hinge 603 joining the mounting member to each wing. The construction of the head is such that it may he moulded in a single piece via conventional injection moulding techniques. It may be moulded of a conventional plastic material such as polypropylene or polyethylene.

Each of the integral wings is provided with reinforcing ribs 604 on the underneath thereof and an upper abutment surface 605 for purposes to become apparent.

Each wing has a forward opening 606 which acts as a locking recess and three locking tabs provided on the underneath of the wings for cooperating with a mounting plate for holding a sponge.

The mounting member includes a socket 610 integrally formed with the mounting member and head. It includes an integral strut 611 extending between the socket and the body of the mounting member.

The socket is provided with a handle opening 612 for receiving a swivel connector 300. The opposite end of the socket is provided with a swivel opening 614 which communicates with the connector housing 616.

A number of locking recesses 618 are provided on either side of the connector housing 616 for locking in the clip 400 in the housing when the pivot mop is assembled.

A clevis socket 620 is provided on either side of the connector housing and is constructed so that the clevis pins 908 and 910 may protrude therethrough into the housing. The clevis socket attaches to the integral cover 624 of the mounting member by the integral ribs 622.

The forward edge of the cover 624 is provided with a key structure 626 for securing a tool mounting plate 550. The tool mounting plate has integral slide elements 552, 554 and 556 which cooperate with the key structure 626 to secure the mounting plate to the front of the pivot mop assembly.

A swivel connector 300 also moulded from a plastic material such as polypropylene or polyethylene is constructed so that it may snugly fit into the socket 610 in such a way that it can rotate relative thereto. The swivel connector is provided with integral pin 302 having a head 304 which protrudes through the swivel opening 614 when the swivel connector is pushed fully into the socket 610. A circumferential flange 306 on the swivel connector abut the socket opening 612 when the swivel connector is inserted into the socket.

A clevis 900 moulded from plastic in one piece includes the fingers 902 and 904 each provided with a reinforcing rib 906. Integral pins 908 and 910 are formed on the internal forward sides of the fingers, the pins being sized so that they may snugly fit into the clevis socket 620. The length of the pins is such that their ends protrude into the connector housing 616 and the pins are each provided with an annular recess 914. 916 by which they may be secured when the clip 400 is snap fitted into the connector housing.

The opposite end of the clevis is provided with a moulded connection configuration 912 which is constructed so that the cover clip 250 may snap fit thereonto. It also includes a socket 918 to receive and hold the clevis connection portion of the control member 800 when the cover clip is applied.

The control member is provided with a bend 804 at the clevis connection end and a hooked portion 802 whereby it may be connected to the sleeve actuator 700.

The actuator sleeve includes a tubular portion 706 whereby it may be slid over a handle 200 and a hand gripping portion 704. A connection opening 702 is provided to secure the control member to the actuator sleeve via the hooked portion.

The sponge 450 is joined lo the underneath of the vent wings via two sponge mounting plates 350. Again, these are formed of moulded plastic and are themselves joined to the sponge most suitably by gluing or welding.

The sponge mounting plates include a number of slidable mounting tabs 352, 354 and 356 which are constructed to interact with the corresponding locking tabs 607 formed on the underneath of the wings, the construction being such that the mounting plates 350 may be slid into place under the wings. Thus the front locking tab 358 can snap fit into the forward opening and lock thereinto. A cover 360 is formed immediately in front of each locking tab 358, the cover being designed to close forward opening 606 when the sponge mounting plate is secured in place.

Assembly of the pivot mop 100 is readily accomplished by inserting one end of the handle 200 into the swivel connector 300 and securing it therein by gluing, nailing, screwing etc.. The actuator sleeve is slid onto the handle and connected to the control member 800 via the hook portion 802 and the opposite end 804 of the control member 800 is connected to the clevis 900. The clevis is formed of a resilient material whereby the fingers may be pulled apart from each other to allow the clevis pins 908 and 910 to be inserted into the clevis socket. The cover clip 250 may then be snapped fitted onto the clevis to hold the control member in place. The clip 400 is pushed up onto the connector housing 616 and the c shaped pin locking portion 402 catches behind the head 304 of the pin 302 to rotably secure the swivel socket within the socket 610. At the same time, the clevis locking portions 404 and 406 slide into the annular recesses 914 and 916 on the pins 908 and 910 to rotatably secure the pins within the connector as well.

The snap fit elements 410 on the clip snap fit into the locking recesses 618 provided on either side of the housing to lock the clip within the housing.

Finally, the sponge which has been secured to sponge mounting plates 350 is secured underneath the wings by sliding the mounting plates into positions such that the slidable mounting tabs 352, 354 and 356 cooperate with the locking tabs 607 and the front locking tab 358 snap fits behind the upper forward edge of the opening 606. As the fully constructed pivot mop assembly functions in substantially the same way as the assembly described with reference to FIGS. 1 to 7, the actual functioning of the mop will not be described any further.

In view of the above description, it will be appreciated that the preferred embodiments of the present invention provide a butterfly sponge mop wherein the head can be positively conformed to a surface for efficacious mopping if the relative angle of the handle and the head is varied during mopping, and wherein both the squeeze mechanism and the sponge mounting arrangement are simple in construction and efficient in operation.

The above embodiments has been described by way of example only and modifications are possible within the scope of the invention disclosed.

What is claimed is:

1. A butterfly sponge mop including:

a mop handle having an axis;

a mop head having a pair of pivotable wings including means for holding the wings in a common plane;

means for mounting a sponge on the wings;

a squeeze mechanism for pivoting the wings to compress the sponge therebetween; and a swivel assembly rotatably connecting one end of the handle to the head, the assembly including a swivel connector defining a central axis the swivel connector being pivotably mounted in a swivel housing portion so as to rotate about and define an axis of rotation wherein the central axis is angled from the axis of rotation and the axis of rotation is offset relative to the axis of the handle and relative to the common plane wherein the rotational configuration of the handle with respect to the head sets the relative transverse angle made between the handle and the common plane regardless of the position of the mop handle relative to the common plane.

2. A butterfly sponge mop according to claim 1 wherein the wings include resilient means for biasing them to a coplanar position.

3. A butterfly sponge mop according to claim 1 wherein the relative angle made between the handle and the common plane may be adjusted by rotation of the handle such that it is less than twenty five degrees.

4. A butterfly sponge mop according to claim 1 wherein the squeeze mechanism includes:

an actuator slidably mounted on the handle and connected via a control member to a compression mechanism;

a pair of opposed fingers each provided with an abutment surface; and a corresponding abutment surface provided on each wing for cooperating with the respective abutment surface on each finger;

the construction of the mop being such that sliding of the actuator in the direction of the mop head causes the abutment surfaces on the respective fingers to push against the corresponding abutment surfaces on the wings to pivot the wings towards each other thereby squeezing the sponge therebetween.

5. A butterfly sponge mop according to claim 4 wherein the control member has a first end and a second opposite end, the second end being angularly offset from the first end to accommodate angular displacement of a compression clevis including the opposed fingers when the handle is rotated with respect to the head.

6. A butterfly sponge mop according to claim 1 wherein the means for mounting a sponge on the wings includes:

a key structure formed on the lower surfaces of each wing; and a mounting plate for each wing attached to the sponge, and each mounting plate is adapted to cooperate with the key structure on a respective wing to secure the sponge to the wings.

7. A butterfly sponge mop according to claim 6 wherein the key structures each include a recess formed on the respective wing, and each mounting plate includes a complementary locking tab arranged to cooperate with the corresponding recess to lock the mounting plate in position underneath the respective wing.

8. A butterfly mop according to claim 6 wherein the squeeze mechanism includes:

an actuator coaxially slidably mounted on the handle and connected via a control member to a compression mechanism;

a pair of opposed fingers each provided with an abutment surface; and a corresponding abutment surface provided on each wing for cooperating with the respective abutment surface on each finger;

the construction being such that sliding of the actuator in the direction of the mop head causes the abutment surfaces on the respective fingers to push against the corresponding abutment surfaces on the wings to pivot the wings towards each other thereby squeezing the sponge therebetween.

9. A butterfly sponge mop according to claim 1 wherein the swivel housing portion includes:

a swivel housing: and the swivel connector attached to the handle and the swivel housing in such a manner as to allow relative rotation between the swivel housing and handle.

10. A butterfly sponge mop according to claim 9 wherein the swivel connector includes a swivel pin rotationally secured to the swivel housing portion in such a manner that the rotation of the swivel pin with respect to the swivel housing portion defines said axis of rotation which is angularly offset with respect to the handle.

11. A butterfly mop according to claim 10 wherein the swivel pin is held within the swivel housing portion by a clip member which snap fits within the swivel housing to cooperate with the swivel pin whereby to rotatably secure the swivel pin within the swivel housing portion.

12. A butterfly sponge mop including:

a mop handle having an axis:

a mop head having a pair of pivotable wings including means for holding the wings in a common plane;

means for mounting a sponge on the wings;

a squeeze mechanism for pivoting the wings to compress the sponge therebetween and comprising an actuator slidably mounted on the mop handle, a control member and a compression mechanism, the control member connecting the actuator to the compression mechanism; and a swivel assembly for rotatably connecting one end of the handle to the head, the assembly including a swivel connector defining a central axis the swivel connector being pivotably mounted in a swivel housing portion so as to rotate about and define an axis of rotation wherein the central axis is angled from the axis of rotation and the axis of rotation is offset relative to the axis of the handle and relative to the common plane wherein the rotational configuration of the handle with respect to the head sets the relative transverse angle made between the handle and the common plane regardless of the position of the mop handle relative to the common plane.

* * * * *